US005207589A

United States Patent [19]

Lettenmayer

[11] Patent Number: 5,207,589

[45] Date of Patent: May 4, 1993

[54] CURRENT CONDUCTING SYSTEM

[76] Inventor: Horst Lettenmayer, Korbinianstrasse 2, Muenchen, Fed. Rep. of Germany

[21] Appl. No.: 780,831

[22] Filed: Oct. 23, 1991

Related U.S. Application Data

[63] Continuation of Ser. No. 460,901, filed as PCT/EP88/00033, Jan. 19, 1988, published as WO 88/05613, Jul. 28, 1988.

[30] Foreign Application Priority Data

Jan. 20, 1987 [DE] Fed. Rep. of Germany ..... 3701449
Jan. 8, 1988 [DE] Fed. Rep. of Germany ..... 3800358

[51] Int. Cl.[5] ..... H01R 25/14

[52] U.S. Cl. ..... 439/112; 439/122; 238/10 A; 191/29 DM

[58] Field of Search ..... 191/22 DM, 29 DM, 33 PM; 238/10 A; 403/312; 439/110, 111, 112, 115, 120, 121, 122

[56] References Cited

U.S. PATENT DOCUMENTS

| | | | |
|---|---|---|---|
| 931,445 | 8/1909 | Low | 174/117 R |
| 1,951,220 | 3/1934 | Tarr | 403/312 |
| 3,148,356 | 9/1964 | Hedden, Jr. | 439/75 |
| 3,294,893 | 12/1966 | Shaffer | 174/70 R |
| 4,907,907 | 3/1990 | Kreusel | 403/312 |

FOREIGN PATENT DOCUMENTS

| | | | |
|---|---|---|---|
| 1204731 | 11/1965 | Fed. Rep. of Germany . | |
| 3120267 | 12/1982 | Fed. Rep. of Germany . | |
| 3716634 | 12/1988 | Fed. Rep. of Germany | 439/122 |
| 3739616 | 2/1989 | Fed. Rep. of Germany | 439/112 |
| 3740549 | 6/1989 | Fed. Rep. of Germany | 439/112 |
| 3828418 | 2/1990 | Fed. Rep. of Germany | 439/121 |
| 764151 | 12/1956 | United Kingdom | 174/117 R |

*Primary Examiner*—Gary F. Paumen
*Attorney, Agent, or Firm*—Townsend and Townsend

[57] ABSTRACT

The current conductor arrangement, more especially for illuminating systems of all types, comprises a current conductor rod whose mutually insulated metallic current conductors make up at least 50% of the cross sectional area of the current conductor rod. It is in this manner that more especially when the current conductor arrangement is used for low voltage applications it is possible to conduct high amperages. Preferably the current conductor rod is round so that the retainer clamps on it, which carry the electrical loads such as lamps, fans and the line, may be swiveled. Advantageous developments of the holders make it possible for them to be additionally swiveled so that the user is practically given a free choice as regards the arrangement and alignment of the electrical load.

12 Claims, 4 Drawing Sheets

CURRENT CONDUCTING SYSTEM

This is a continuation of application Ser. No. 07/460,901, filed as PCT/EP88/00033, Jan. 19, 1988, published as WO 88/05613, Jul. 28, 1988, now abandoned.

FIELD OF THE INVENTION

The invention relates to a current conductor arrangement in the form of a current conductor rod, which has at least two metallic current conductors which are freely accessible and are insulated by an insulating material and whose cross sectional area consists for at least 50% of the material of the material of the current conductors.

BACKGROUND OF THE INVENTION

The German specification 1,204,731 refers to a current conductor arrangement which has grooves or recesses, in each of which a metallic tape with a small cross section is placed. The contacts with the electrical appliances, which are attached to the current conductor rod, are with the metallic tapes in the groove of the current conductor rod for the transmission of current in the electrical contact. Axial displacement of the appliance contacts on the current conductor rail is admittedly possible, but it is not possible to twist the electrical appliance on the outer periphery of the current conductor rod, since the electrical contact of the appliance is set in the groove or grooves with the metallic tape and thus the current conductor there. Furthermore, owing to the small cross section of the metallic tape the known arrangement is only suitable for low amperages.

The German examined specification 3,120,267 describes a current conductor arrangement having rail parts between which an insulating member is placed. This insulating member has two rib which project past the peripheral line of the rail parts. In this known current conductor arrangement the two ribs are absolutely necessary. If they were absent, there would be short circuiting on twisting the contact element by which the lamp fixed to the contact element is supplied with current. A further function of the rib-like insulating intermediate layer projecting past the peripheral limit of the circular portions is that of providing a switching and switching off function. The ribs needed for preventing a short circuit do however have the disadvantage that the contact parts, with which the lamps are attached to the rail and via which the electrical conduction takes place between the lamp and the current rail, is not able to be evenly turned over the entire periphery of the current conducting rail without the projecting ribs impairing both the mechanical strength of the press fit and also the electrical contact between the lamp and the current conductor. The contact surfaces of the lamps are not positioned by the ribs provided on the current conductor in relation to said current conductor rod and the contact is only provided over a small area of the contact interfaces so that the contact conductor cross section is small. The same also applies for the suggestion made in the said reference about the cross section of the current conductor being polygonal and adapted to the circular cross section form. Even in the case of such a design of the current conductor the contact area between the contact interface of the lamp and the rail part is limited to the edges of the polygon. Apart from the fact that this impairs the mechanical strength of the contact connection by the small area between the lamp contact and the current conductor and with a reduction in friction, the contact transition cross section between the lamp contact and the outer face of the current conductor is small so that there will be small transition cross sections and thus high current densities which on twisting of the contact element lead to sparking and arcing.

SUMMARY OF THE INVENTION

Accordingly the aim of the invention is to devise a current conductor arrangement, which while being very simple to product, to handle and to fit, provides for great adaptability as regards fixation, alignment and adjustment of the electrical appliances, as for instance in the form of illuminating devices and particularly provides for a reliable mechanical and electrical connection over the entire periphery of the current conductor without there being the danger of a short circuit on twisting the contact elements.

Taking as a starting point the known current conductor arrangement of the said German specification the said aim is achieved inasmuch as the insulating material and the material of the current conductors form a surface which is uniformly circular in cross section and the freely accessible peripheral surfaces of the current conductors subtend a peripheral angle which is smaller than the peripheral angle of the insulating peripheral surfaces.

The present invention makes it possible to apply and adjust electrical appliances, which as will be described in detail below, may be clamped on the current conductor rod so that they may be set not only axially but also in their rotational position as may be desired. The feature of the invention that the insulating material and the material of the current conductors is such that a surface is formed which is uniformly circular in cross section, that is to say that the current conductor surface is not radially offset in relation to the insulation surface of the current conductor rod so that the two material shave a uniform circular periphery, means that in every rotational setting of the clamped-on electrical appliance there is both a secure mechanical connection and also a good electrical contact, since the contact interfaces between the clamped on appliance and the current conductor rod always have the given, maximum area. In this way it is possible to twist an electrical appliance on the current conductor rod without impairing the mechanical connection and/or the electrical contact effect so that the user may apply or reset the electrical appliance with a free choice both as regards the rotational setting on attachment and is a possibility of simple resetting of the position thereof.

The free rotatability of the appliance with a good electrical contact via broad contact interfaces is made possible only by the further feature of the invention that the freely accessible peripheral surfaces of the current conductors each subtend a peripheral angle which is smaller than the peripheral angle of the insulating peripheral surfaces. In this manner it is possible to ensure that on twisting a holding clamp around the current conductor rod there will be no short circuit and switching on and off is possible since the contact surfaces of the clamp are brought into and out of contact with the current conductors of the current conducting rod. The current conducting arrangement in accordance with the invention is more particularly intended for low voltage applications. For attachment it is possible to sue simple holding clamps which are either themselves conducting or have internal contact surfaces for the production of the contact with the current conductors of the current conducting rod.

In accordance with a preferred embodiment of the invention the current conductor rod consists for at least 80% of the material of the current conductor. In this manner it is possible to make even better use of the current conductor rod for the conduction of high amperages. This high metal fraction means that the current conductor arrangement is able to carry high amperages in low voltages applications.

In accordance with a preferred feature of the invention the freely accessible current conductor peripheries circumferentially alternate with the peripheries of the insulating material. The configuration of the cross sectional form of the current conductors within the current conductor rod may then be selected to be in accord with the given circumstances of the conditions which may later arise. It is particularly advantageous if the current conductor rod is made up of segments or part-segments, which are placed in a circumferentially alternating succession, of the current conductor and insulating material.

In accordance with the further form of the invention the freely accessible peripheral surfaces of the current conductors each subtend a peripheral angle, which is smaller than the peripheral angle of the insulating surfaces. It is in this manner that simple twisting of the retaining clamps may be used to put the contact surfaces of the clamps into and out of contact with the current conductors of the current conductor rod. This is a simple way of switching the load on and off.

It is particularly convenient if, in the case of a current conductor rod with two metallic current conductors, its two freely accessible peripheral surfaces subtend circumferential angle of 80° and the peripheral insulating surfaces subtend angles of 100° respectively. This ensures that a retaining clamp, which has a contact angle on the current conductor rod of approximately 90° in each case in both directions, may be "switched" in previously described manner.

In connection with the above described forms of the invention it is to be noted once again that in the case of a relatively large circumferential angle of the insulating material on the peripheral surface the proportion of current conductor may be large in relation to the cross section of the current conductor rod, since the interior of the current conductor rod—apart from a relatively thin insulating layer or plate—may consist of the metallic current conducting material.

In keeping with a preferred form of the invention the current conductor rod may also be in a bent form, the metallic current conductors being arranged in the inner and outer radiuses of curvature. Therefore the metallic current conductors form the member resisting tension and compression forces when the current conductor rod is bent in a bent form.

In accordance with a further form of the invention the material of the current conductors is pressed to combine it with the insulating material. This leads to simple manufacture with an intimate join between the current conducting metal and the insulating material.

The current conductor rod in accordance with the invention may be cut off by the user to the desired length owing to the simple structure. A simple form of preparation of the cut end means that the current conductor rods may be then coupled with each other.

Preferably the current conductor rod is machined to have a smooth surface.

The current conducting arrangement in accordance with the invention is able to serve not only as a conducting element, that is to say as a current conductor, but also as a mechanical supporting element for very many different purposes. As an example the current conductor rod of the invention may be used as a current conductor cum mechanical support as legs of stands, picture supporting rails, rod-like parts of interior decoration arrays, shelving and other supporting elements, and as a rail on which electric bulbs are carried. In industrial applications the current conductor rod may be used as a support for sliding fixtures in transfer lines, as a support rail for modern pneumatic conveying systems, as a current conductor for electroplating systems, or as a contact rail in labs, more especially for the feeding of clamp-on low voltage units. It is furthermore possible for the current conductor rod to be used additionally as signaling or alarm conductor for the carrier voltage of modulated RF signals, as for example alarm signals. Owing to the simple, sturdy construction which is able to be put so many different uses, it is possible for the current conductor arrangement of the invention to be used for the most different applications to a practically unlimited extent.

In keeping with a particularly advantageous embodiment of the invention electrical loads, such as lamps, fans, motors, clocks, winches, electrical components and the like are attached by retaining clamps to the current conductor rod, the retaining clamps having internal contact surfaces, which are in contact with the current conductors of the current conductor rod for the electrical supply of the loads. As we have already seen in the case of a round current conductor rod it possible not only to displace the retaining clamps axially on the current conductor rod, but also to twist them in a plane perpendicular to the current conductor rod axis. The retaining clamps are to be perpendicularly snap fitted onto the current conductor rod in the manner of cloths pegs so as to ensure a full mechanical and electrical connection between the current conductor rod and the retainer clamp while on the other hand axial displacement or twisting of the clamp is possible without loosening any screw.

In accordance with a further embodiment of the invention connecting means are provided which connect two current conductor rods, which each have two current conductors, mechanically and electrically with each other. This makes it possible to extend the current conductors to any required extent.

Preferably the design is such that the connecting means each consist of two electrically conducting elements, such elements not being in contact with each other but being able to be screwed to a respective current conductor. Since furthermore on the continuation of a current conductor rod the individual current conductors are to remain electrically insulated from each other, the connecting means are so designed that one respective element only connects the corresponding two current conductors of two current conducting rods.

It is more especially an advantage if the electrically conducting elements are cylindrical segments, whose internal radius of curvature is generally equal to the radius of the current conductor rod. This results in cuff-lile connecting means, in which the current conductor rods are well secured and are reliably connected electrically. Preferably the segment angles of the cylinder segments are smaller than 180° in order to keep the cylindrical segment elements from contacting each other after assembly.

In accordance with a further feature of the invention the electrical conducting elements are angular connecting elements, whose limbs to be connected with the current conductors have the form of the segment of cylinder, whose inner radius of curvature is equal to the radius of the current conductor rod. The connector angles may then preferably be 90°, although any other angle is possible. This leads to a large number of different possibilities as regards assembly and erection for the current conductor arrangement in accordance with the present invention. The connecting means may then be attached in a simple manner using screws to the current conductors, which have previously been provided with suitable tapped holes. Assembly is very simple and even without manual skill and technical knowledge a great variety of different configurations and designs may be realized with the current conductor arrangement of the invention at any site.

BRIEF DESCRIPTION OF THE DRAWINGS

The invention will now be described in more detail with reference to the drawings by way of example.

DESCRIPTION OF THE PREFERRED EMBODIMENT

Figure 1:
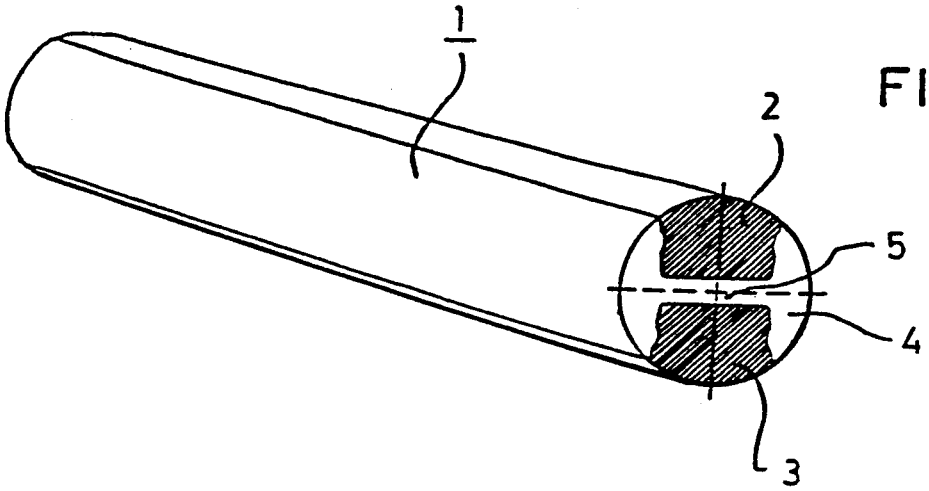
FIG. 1 shows one working example of the invention in the form of a round or cylindrical current conductor rod.

The current conductor rod 1 shown in perspective in FIG. 1 has two current conductors 2 and 3, which are electrically insulated from each other by insulating material 4. Between the current conductors 2 and 3 there is a layer 5 of the insulating material.

Figure 2:
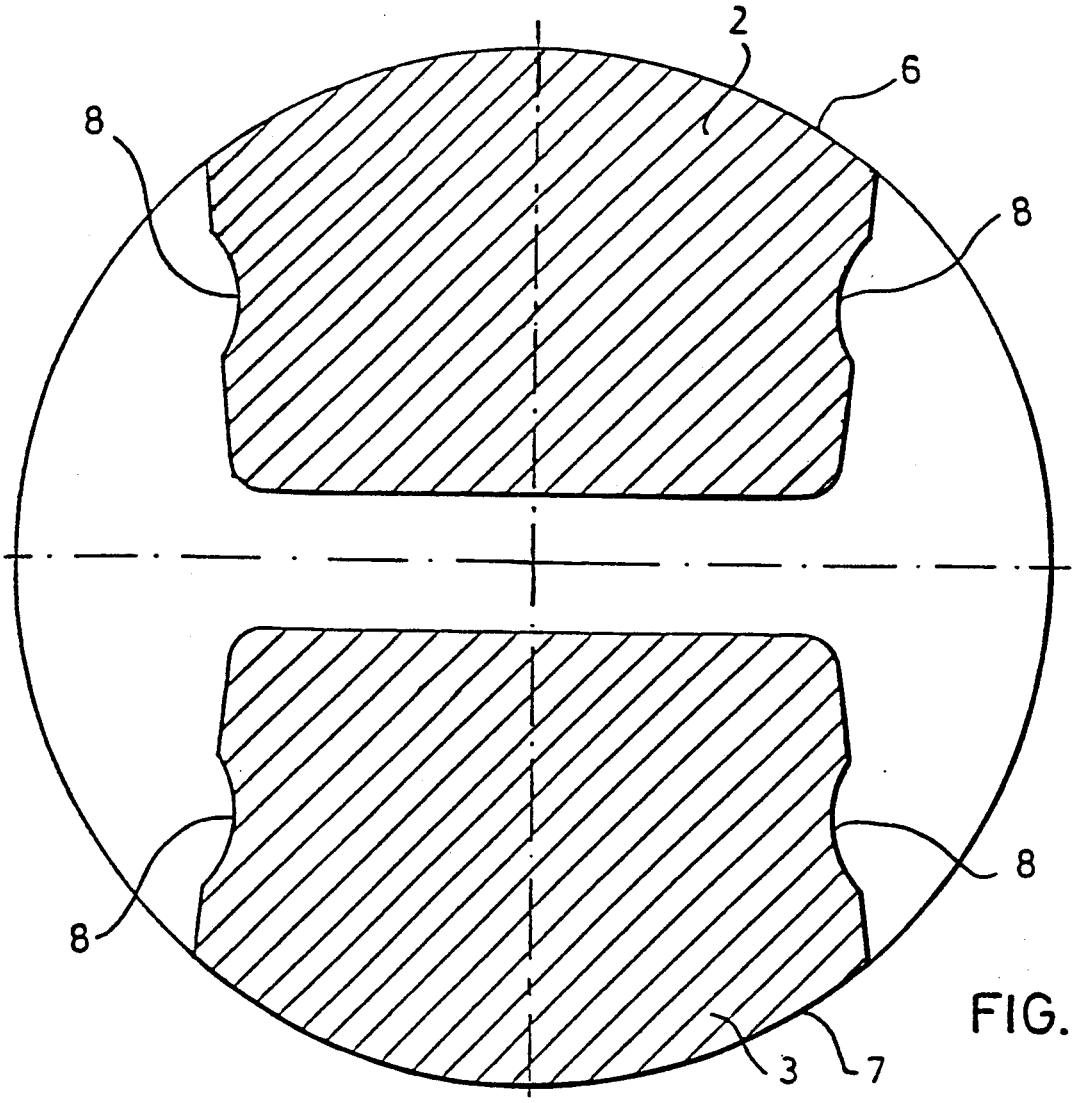
FIG. 2 shows a cross section taken through the current conductor rod of FIG. 1 on a larger scale.

As will be seen from FIGS. 1 and 2 the current conductor rod 1 has a round cross section in the illustrated working example of the invention. The external surfaces 6 and 7 of the current conductors 2 and 3 form a part of the periphery of the overall current conductor rod 1. The remaining surface parts of the current conductor rod 1 are constituted by the surface of the insulating material 4.

Preferably the entire current conductor rod 1 is machined to a fine finish and has a smooth, circular surface. The current conductor surfaces 6 and 7 are exposed and serve to make contact with the retainer clamps which are yet to be described and which are utilized to connect electrical loads with the current conductor arrangement.

The configuration of the current conductors 2 and 3 in the interior of the current conductor rod 1 is such that the greater part of the cross sectional area of the current conductor rod 1 consists of the current conducting material so that in relation to the cross section or to the diameter of the current conductor rod 1 there is a large current conducting cross section and despite the compactness of the current conductor rod 1 it is able to conduct heavy currents without the current conductor rod 1 heating up.

Recesses 8 on the current conductors 2 and 3 (see more especially FIG. 2) serve to firmly join the insulating material with the current conductors 2 and 3.

As an alternative to the construction shown in FIGS. 1 and 2 the current conductor rod 1 may have the current conductors and the insulating material in the form of circular segments. The working example of the invention shown in FIGS. 1 and 2 is however superior to a design with circular segments inasfar as a larger cross sectional area of the current conductor rod 1 is available for use as a current conducting means.

FIGS. 1 and 2 shown a current conducting arrangement with two current conductors. It is naturally also possible to create current conductor rods 1 with more than two current conductors for a polyphase supply system and to enable the electrical loads to be independently supplied with current without the electrical loads, which are supplied with different phases having to have separate current conductor arrangements or current conductor rods.

In accordance with specific requirements it is also possible for the current conductor rod to be made oval, square or otherwise rectangular in cross section as opposed to round. The round form does however offer the advantage that the retainer clamps may be also swiveled around the current conductor rod and thus moved into any desired settings.

Figure 3A:
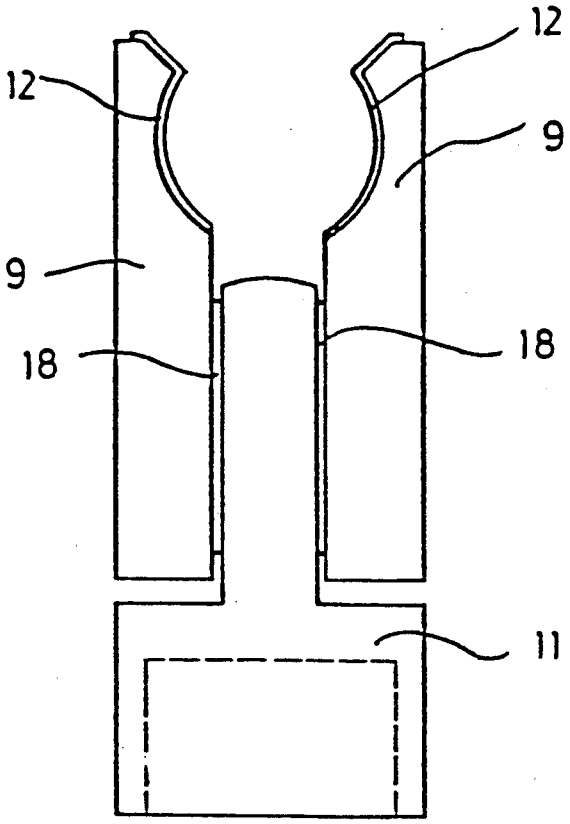
FIG. 3*a* shows a working example of a retainer clamp in accordance with the instant invention as seen from the side.
Figure 3B:
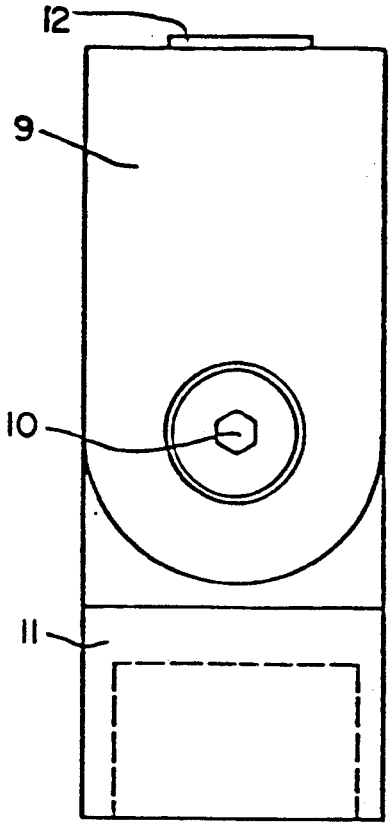
FIG. 3*b* shows the retainer clamp of FIG. 3*a* looking in a direction offset through 90° from that of FIG. 3*a*.

FIGS. 3*a* and 3*b* show a working example of a retainer clamp. A holder 11 is secured in place between two retainer clamp legs 9 by means of a screw 10. The holder may for example be a lamp socket or other attachment means for an electrical load, as for instance a fan, a motor, a clock or other contrivance. The holder 11 is able to be turned between the retainer clamps about the axis of the screw 10. The retainer clamp legs 9 have such a form of their inner faces that they fit onto the current conductor rod 1. To produce the electrical contact there are contact springs 12 which are arranged in the interior of the retainer clamp legs 9. They will be explained in more detail below.

Both the retainer clamp legs 9 and also the contact making spring 12 are produced from an elastic material so that the entire retainer clamp may be pressed onto the current conductor rod 1.

Figure 4A:
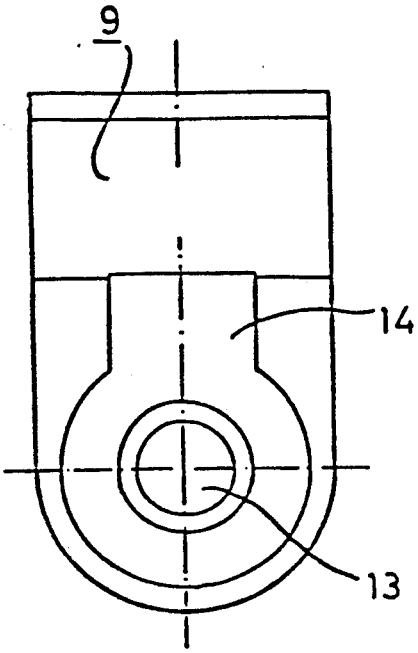
FIGS. 4*a* to 4*c* show one retainer clamp leg looking in three different directions offset by 90° from each other.
Figure 4B:
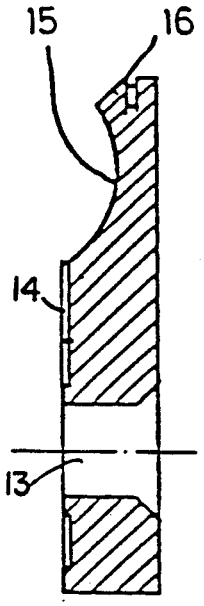
Figure 4C:
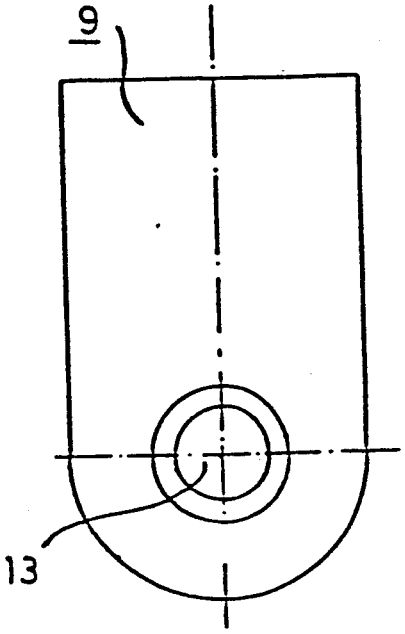
Figure 5A:
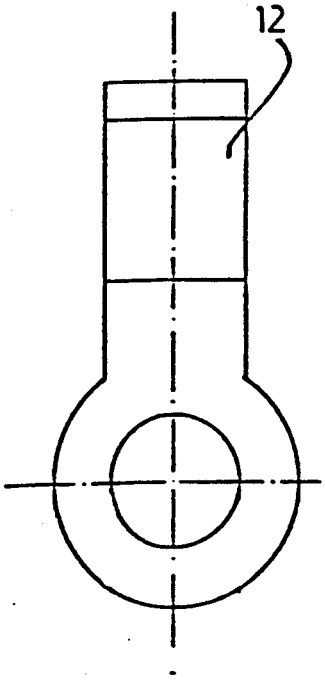
FIGS. 5*a* to 5*c* show a contact spring looking in three directions offset by 90° from each other.
Figure 5B:
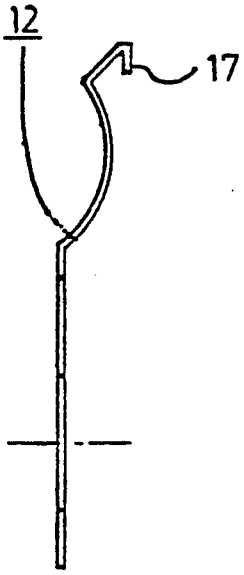
Figure 5C:
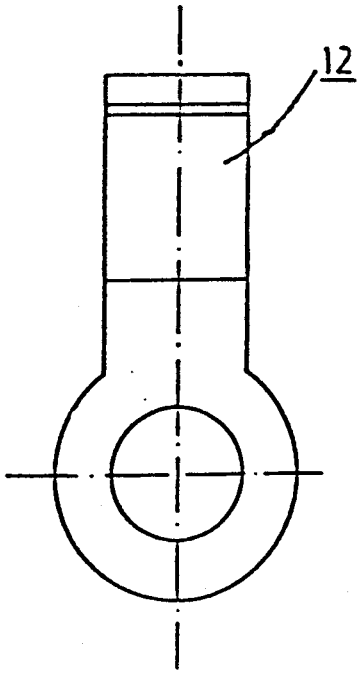

In FIGS. 4*a*, 4*b* and 4*c* the leg of a retainer clamp is shown separately and from different sides in order to make it clearer. For the screw connection there is a hole 13 around which there is a recess 14 in which the contact making spring 12 (see also FIGS. 5*a*, 5*b* and 5*c*) is arranged. As will be more especially seen from FIG. 5*b* the form of the contact making spring 12 matches the round form of the retainer clamp leg 9 where the spring engages the current conductor rod 1, this being shown in FIGS. 3*a* and 3*b* as well. The recess 15 in the retainer clamp leg is complementary to the configuration of the current conductor rod 1; in the illustrated working example of the invention the current conductor rod 1 is round so that the recess 15 is in the form of a circular segment. A protrusion 17 on the contact making spring 12 is arranged in a groove 16 at the end of the retainer clamp leg 15 in order to locate the contact spring at the end of the retainer clamp leg 9 as well.

The contact spring 12 conducts the current from the current conductor rod 1 via metallic washers, as for instance copper washers 18 to the electrical terminals of electrical loads, which are arranged on or in the holders 11.

Figure 6A:
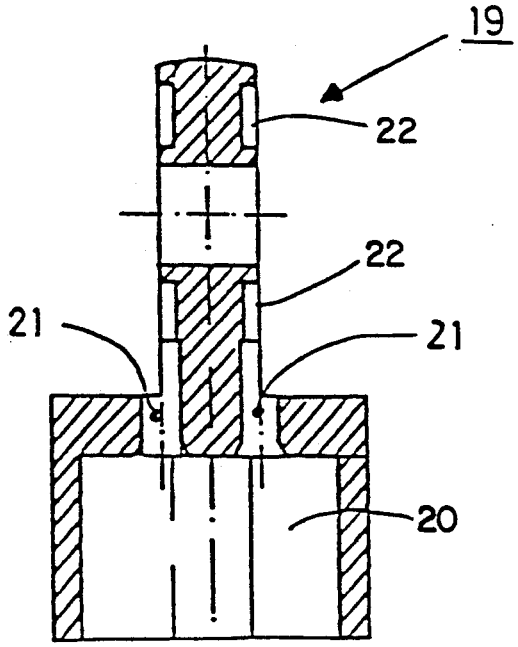
FIGS. 6*a* and 6*b* show a working example of the invention in the form of a holder of an electrical load.
Figure 6B:
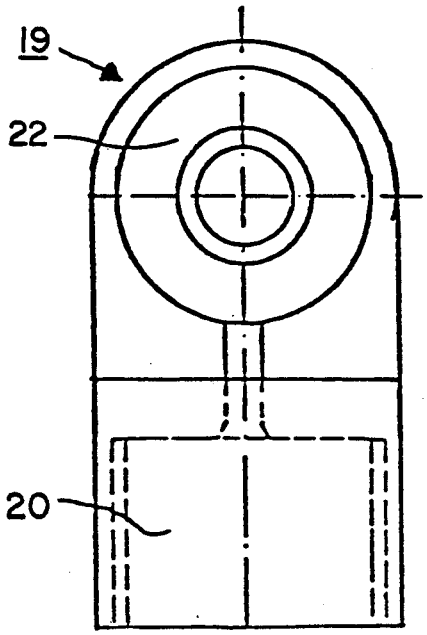

FIGS. 6*a* and 6*b* show a preferred form of the holder shown in FIGS. 3*a* and 3*b* and more especially its attachment arm 19 on which the retainer clamp legs 9 and the contact springs 12 are arranged.

A chamber 20 provided in the holder 11 has an electrical load means, as for example lamp socket, arranged therein. The two electrical connection wires are led through two holes 21 in the wall so that the bared, free end of the one wire is arranged in the circular recess 22 on the one side of the retainer arm and the free end of the other wire is arranged in the circular recess on the other side of the retainer arm 19. A metal washer, and preferably such a washer with good conducting properties such as copper, is placed in the wire ends in the recesses so that when the retainer clamp is assembled it rests on the part of the contact making spring 12 which is arranged between a retainer clamp leg and the holding arm 19 of the holder 11 on the other side by the screw 13. By firmly tightening the screw 13 acting on the retainer clamp legs the washer 18 is pressed firmly onto the wire ends in the circular recesses 22 of the electric load so that a good contact and a low ohmic resistance is ensured. On the other hand the metal washers 18 abut the parts pressed between the retainer clamp legs 9 of the contact making springs 12 which are also made of a good conductor or electricity, preferably copper. This arrangement means that despite the a very good electrical connection between the terminal wires and the washers 18 so there is a free sliding action of the terminal wires in relation to the washers 18 so that the holding arm 19 and thus the holder 11 may be swiveled in relation to the retainer clamp legs without it being necessary to slacken off or remove any screw. There is thus an extremely simple way of attaching electrical loads and adjusting their settings. Such loads may for instance be lamps, fans and the like. This is because the possible swiveling of the retainer clamp on the current conductor rod 1 and the pivoting of the holder 11 in relation to the retainer clamps represent the simplest manner of readjusting or modifying the arrangement at any time.

Figure 7A:
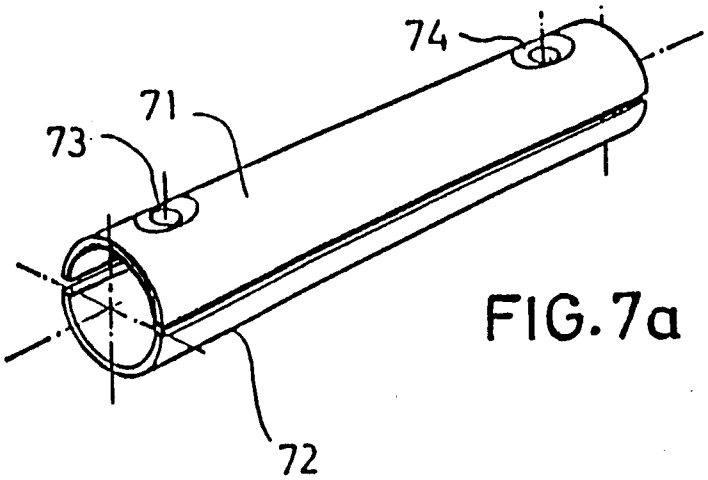
FIGS. 7*a* to 7*c* show connecting means for connecting round current conductor rods.
Figure 7C:
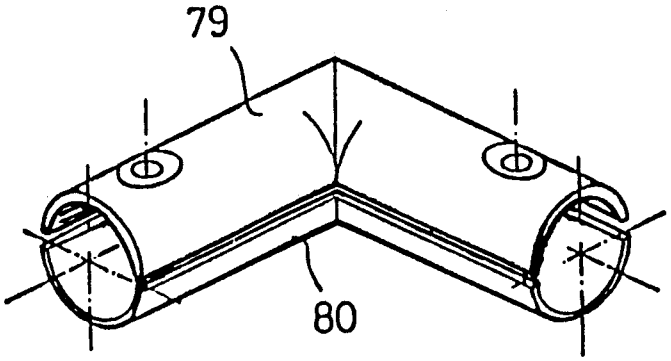
Figure 7B:
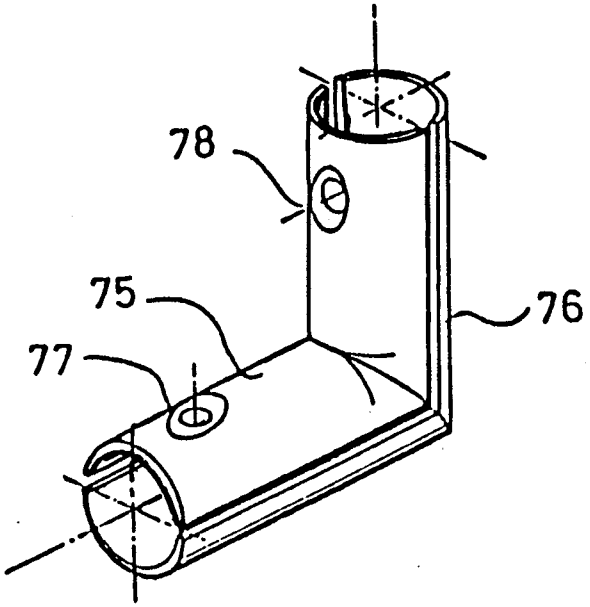

FIGS. 7*a*, 7*b* and 7*c* show working examples of the connecting means, with which round current conductor rods 1 each having two current conductors 2 and 3 may be connected with each other in a manner which is mechanically firm and also provides a good electrical contact.

The construction of FIG. 7*a* provides for the connection of two current conductor rods 1 in line. This connecting means of FIG. 7*a* has two essentially symmetrical elements 71 and 72, which are in the form of cylindrical segments. The inner radius of curvature is generally the same as the radius of the current conductor rod.

The current conductor rods 1 are provided with tapped holes at the ends to be connected in the two current conductors 2 and 3, such holes extending in a radial direction. The threaded holes come to an end in the respective current conductors 2 and 3 as blind holes.

Then the elements 71 and 72 in the form of segments of cylinders are placed over the ends to be connected. Screws are inserted through the prepared holes 73 and 74 in the upper element 71 and through the holes, not shown in the figure, in the lower element 72. Such screws are screwed into the tapped holes in the current conductors 2 and 3 of the current conductor rods 1 and thus secured. The result is a cuff-like connection between two current conductor rods 1.

In order to ensure that the two current conductor rods do not make electrical contact with each other the cylinder segments have a segment angle which is less than 180° so that the segments do not touch after attachment on the current conductor rods and a space remains between them. Owing to the blind threaded holes it is not possible for there to be any electrical connection via the screws.

FIG. 7*b* shows a connecting means for an angular connection. In the working example shown this angle is 90°. The legs of the two angular elements 75 and 75 on both limbs again have the screw holes 77 and 78 and the form of a segment of cylinder as described in connection with the example shown in FIG. 7*a*. The current conductor rods 1 to be connected may in this case be cut with a mortise. It is however necessary for the ends of the current conductor rods 1 to project so far into the angular connecting elements that the screws may be screwed into the corresponding tapped holes of their current conductors 2 and 3.

FIG. 7*c* also shows a rectangular connection means with connecting elements 79 and 80. The connection of the current conductor rods 1 is as in the connecting means shown in FIGS. 7*a* and 7*b* and described in connection therewith. The connecting means shown in FIG. 7*c* is however necessary in addition to the one shown in FIG. 7*b* if a connection of the current conducting rods in a single direction is desired, which is directed out of the plane as is defined by the limbs of the connecting means as shown in FIG. 7*b*.

In the angular connecting means shown in FIGS. 7*b* and 7*c* the connection angle is 90°. If desired the connecting means may be made with other angles different to 90°, as for example with a connection angle of 60°.

The connection means make possible adaptable constructions in many different forms to suit different needs with the current conductor rods 1.

Although the invention has been explained with reference to preferred embodiments thereof, it will be clear to those in the art that modifications, developments and amplifications thereof are possible without departing from the essential gist and spirit of the invention.

I claim:

1. A support and current conductor for an electrical appliance in the form of a current conductor rod, comprising at least two metallic current conductors, the conductors being freely accessible for contacting, and insulated with an insulating material, at least 50% of the cross sectional area of the rod being material of the current conductors, the insulating material and the material of the current conductors forming a surface of the current conductor rod of a uniform circular cross section, the current conductors having freely accessible peripheral surfaces each subtending a peripheral angle which is smaller than a respective peripheral angle of the insulating peripheral surfaces, and at least one retainer clamp for applying an electrical appliance to the current conductor, the retainer clamp having internal contact surfaces for both establishing electrical contact with the current conductors of the rod and for mechanically securing said retainer clamp to said conductor rod and preventing the electrical appliance from moving relative to the rod.

2. The current conductor arrangement as claimed in claim 1, wherein at least 80% of the cross sectional area of the current conductor rod comprises the material of the current conductors.

3. The current conductor arrangement as claimed in claim 2 wherein the freely accessible current conductor peripheral surfaces and the peripheral surfaces of the insulating material alternate about the periphery of the current conductor rod.

4. The current conductor arrangement as claimed in claim 1 wherein the current conductor rod comprises segments of current conducting and insulating material alternating about the circular periphery.

5. The current conductor arrangement as claimed in 2 wherein two metallic current conductors are provided whose freely accessible peripheral surfaces subtend a peripheral angle of 80°, and wherein the insulating peripheral surfaces subtend a peripheral angle of 100° respectively.

6. The current conductor arrangement as claimed in claim 1 wherein the current conductor rod is bent and the metallic current conductors are arranged at the inner and outer radius of curvature of the rod.

7. The current conductor arrangement as claimed in claim 1 wherein the material of the current conductors is joined to the insulating material by pressing.

8. The current conductor arrangement as claimed in claim 1 wherein the current conductor rod is in the form of a simultaneously supporting and conducting element for one of a current supply and illuminating system, shelving, transfer lines, support rails, lamp support rails, electroplating systems, exhibition and stand systems for use in a lab or industrial plant.

9. The current conductor arrangement as claimed in claim 1 including connecting means for mechanically and electrically connecting together two current conductor rods each having two current conductors.

10. The current conductor rod as claimed in claim 9 wherein the connecting means respectively comprise first and second electrically conducting elements adapted to be screwed to one current conductor, the elements being spaced so as not to be in contact with each other.

11. The current conductor arrangement as claimed in claim 10 wherein the electrically conducting elements are semi-circular segments of cylinders whose outer radius of curvature subtend an angle less than 180° and whose inner radius of curvature are generally equal to the radius of the current conductor rods.

12. The current conductor arrangement as claimed in claim 10 wherein the electrically conducting elements are angular connecting elements having limbs to be connected with the current conductors in the form of a semi-circular segment of a cylinder with an outer radius of curvature that subtends an angle less than 180° and with an inner radius of curvature substantially equal to the radius of the current conductor rod.

* * * * *